US006811070B2

(12) United States Patent
Takada

(10) Patent No.: US 6,811,070 B2
(45) Date of Patent: Nov. 2, 2004

(54) ELECTRIC STAPLER

(75) Inventor: Tokinori Takada, Matsudo (JP)

(73) Assignee: ELM International Co., Ltd., Tokyo (JP)

( * ) Notice: Subject to any disclaimer, the term of this patent is extended or adjusted under 35 U.S.C. 154(b) by 0 days.

(21) Appl. No.: 10/406,316

(22) Filed: Apr. 4, 2003

(65) Prior Publication Data

US 2004/0016789 A1 Jan. 29, 2004

(51) Int. Cl.[7] ..... B25C 1/06

(52) U.S. Cl. ..... 227/120; 227/119; 227/131; 227/155

(58) Field of Search ..... 227/6, 7, 119, 227/120, 131, 155

(56) References Cited

U.S. PATENT DOCUMENTS 4,726,505 A * 2/1988 Okazaki ..... 227/132
5,007,572 A * 4/1991 Chung-Cheng ..... 227/7
5,222,645 A * 6/1993 Sueda ..... 227/7
5,330,086 A * 7/1994 Shimomura et al. ..... 227/7
5,427,296 A * 6/1995 Chen ..... 227/7
5,657,918 A * 8/1997 Shimomura et al. ..... 227/7
6,068,173 A * 5/2000 Sueda ..... 227/7
6,104,162 A * 8/2000 Sainsbury et al. ..... 320/111

FOREIGN PATENT DOCUMENTS

JP 2000-317861 11/2000

* cited by examiner

*Primary Examiner*—Stephen F. Gerrity
*Assistant Examiner*—Nathaniel Chukwurah
(74) *Attorney, Agent, or Firm*—Greenblum & Bernstein, P.L.C.

(57) ABSTRACT

A compact, lightweight and rechargeable electric stapler for automatically punching holes in documents and the like is provided wherein a fixed switch is fixed to the case body and an actuating bar is moveable at the front end and back end, so the switch is durable and also the presence of staples can be determined at a glance with a LED. The electric stapler comprises a case body, drive train, wiring board, magazine frame, an arm, a fixed switch wherein an actuating switch for actuating the drive train (motor) is mounted on the case body, and a moveable actuating bar coupled to the fixed switch and mounted between the case body and frame.

15 Claims, 5 Drawing Sheets

ELECTRIC STAPLER

BACKGROUND OF THE INVENTION

1. Field of the Invention

The present invention relates to an electric stapler that is able to use staples to punch holes in sheaves of documents or the like, bend the staples and bind the documents, and particularly to an electric stapler which has a moveable actuating bar and switch mounted in a fixed manner on the case.

2. Description of Related Art

The stapler is commonly used as a tool for filing documents and the like in the form of sheaves of sheets. Manual staplers are common but require greater strength as the sheaves of sheets become thicker. The electric stapler was invented to obviate the need to manually push the binding machine. Electric staplers are able to perform binding automatically with electric driving force. A typical example of an electric stapler is the one taught in Japanese Unexamined Patent Publication No. 2000-317861.

The electric stapler taught in this publication has a structure whereby, as a dispensing arm is driven by a motor to move in the downward direction of a pressing member, a magazine frame moves downward at its front end under its own weight, until the lower surface of the front end of the magazine frame touches the upper surface of the object to be stapled. It is formed such that, when the pressing member is moved to its lowest point, the dimension between the catch of a suspension member and the support is a dimension such that the front end of the dispensing arm can move due to movement of the pressing member so that a staple stored in the magazine frame is pushed out from the dispensing outlet.

In addition, the magazine frame has a structure comprising a case provided with a staple storage area and a case cover that covers the upper surface of this case; said structure being such that loading of staples can be performed by pulling the case from the case cover at the front end of the magazine frame in the case meeting area which is formed by the side wall in the lengthwise direction of the case cover and the side surface in the lengthwise direction of the case, in a long mutually meshing groove and long protrusion.

Moreover, the constitution is such that a switch that closes the electrical circuit of the motor upon contact with the edge of the object to be stapled, which is inserted between the base and the front end of the magazine frame, is provided on a moveable member that can be moved from the front end of the magazine frame toward the back end.

Conventional electric staplers have a structure wherein the switch for actuation itself moves from the front end to the back end. Since the durability of the switch over long-term use is therefore poorer than that that of a fixed switch, conventional electric staplers are prone to breakage. In addition, the dimension between the catch of the suspension member and the support must be one that permits the engagement of the pressing member, so it naturally must be of a certain size.

Therefore, a need has been felt for the development of a compact, lightweight and rechargeable electric stapler with a durable actuating switch that can be used on both battery and AC power.

The object of the present invention is to overcome the foregoing problems by fixing the actuating switch to the case body and also permitting the actuating bar coupled to the fixed switch to move from the front end to the back end, thereby providing an electric stapler whose actuating switch is more durable than that of a conventional electric stapler. An additional object is to provide thereby an electric stapler with a compact, lightweight and rechargeable structure, where the presence of staples can be determined at a glance from outside by means of an LED display.

SUMMARY OF THE INVENTION

In order to achieve the above purpose, the present invention provides an electric stapler comprising: a case body, a drive train consisting of a motor and gears, a wiring board that has electrical circuitry, a magazine frame that stores staples, an arm that pushes staples stored in said magazine frame from above such that they penetrate and staple sheaves of documents or the like, a fixed switch mounted on the case body and equipped with an actuating switch for actuating the drive train (motor), and a moveable actuating bar coupled to said fixed switch, which is mounted between the case body and frame.

The fixed switch preferably comprises the actuating switch for actuating the motor of the drive train, a slide member coupled to a crank of the actuating bar, and a switch base on which said actuating switch and said slide member are provided and which is mounted on the case body.

In addition, the actuating bar preferably comprises a paper guide serving as a stopper for the sheaf of documents or the like to be stapled, a slider member that is pushed by the sheaf of documents or the like and actuates the crank, and a crank coupled to the slide member of the fixed switch.

Moreover, the electric stapler preferably has a battery installed as an independent source of driving power, and an AC power connector and AC-DC converter for an AC power supply provided separately on said wiring board.

In addition, the electric stapler preferably further comprises an LED display that lights when the staples run low, whereby the presence of staples within the magazine frame can be easily determined at a glance from outside.

With the electric stapler according to the present invention, the fixed switch provided with an actuating switch is fixed to the case body, and the actuating bar coupled to the fixed switch is moveable from the front end to the rear end. For this reason, it has an advantage in that the load on the actuating switch is lessened and breakage will occur less often. In addition, the invention can provide a product that is compact, lightweight and can be used anywhere.

DESCRIPTION OF THE PREFERRED EMBODIMENTS

Figure 1:
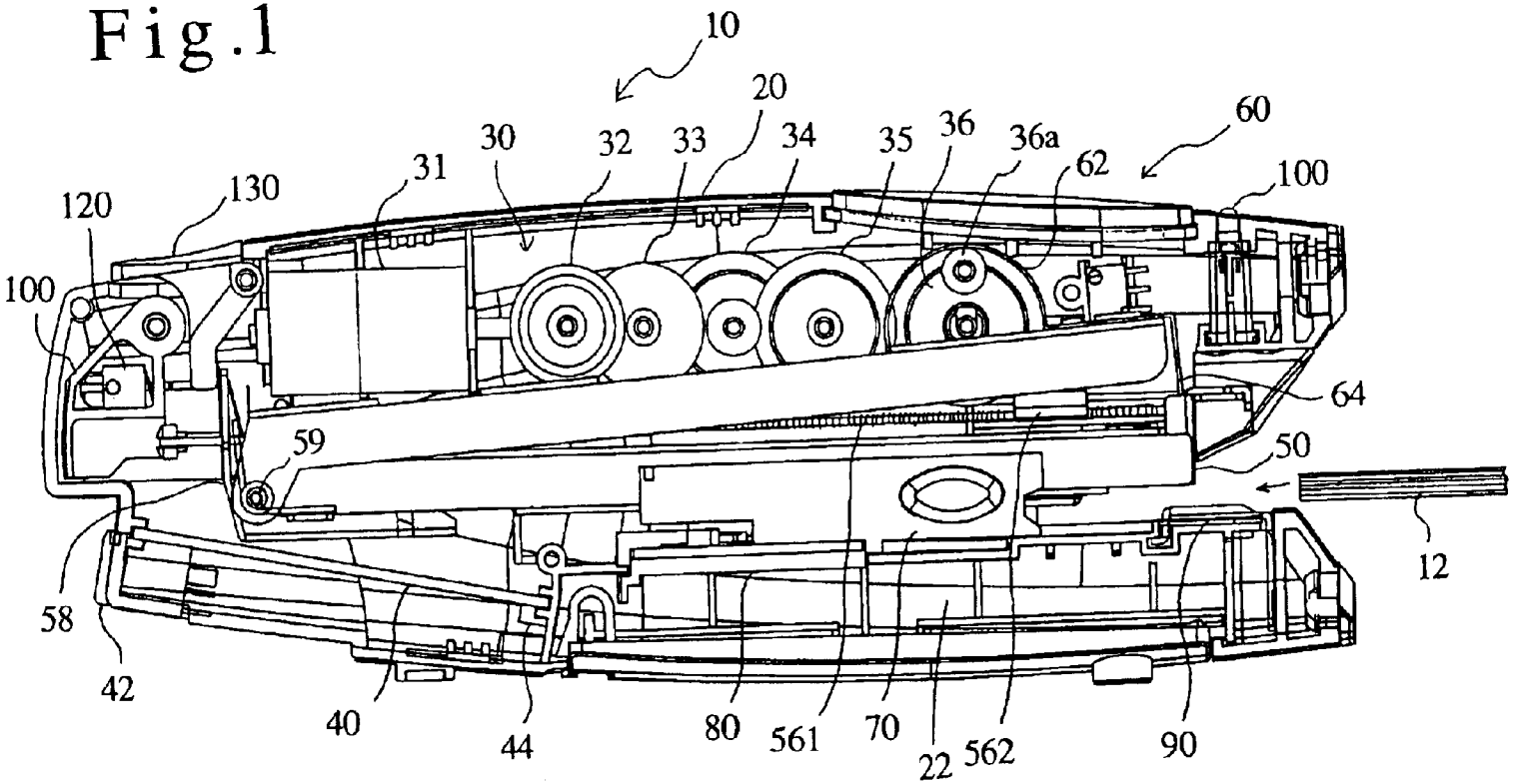
FIG. 1 is a side view of the electric stapler according to the present invention.
Figure 2:
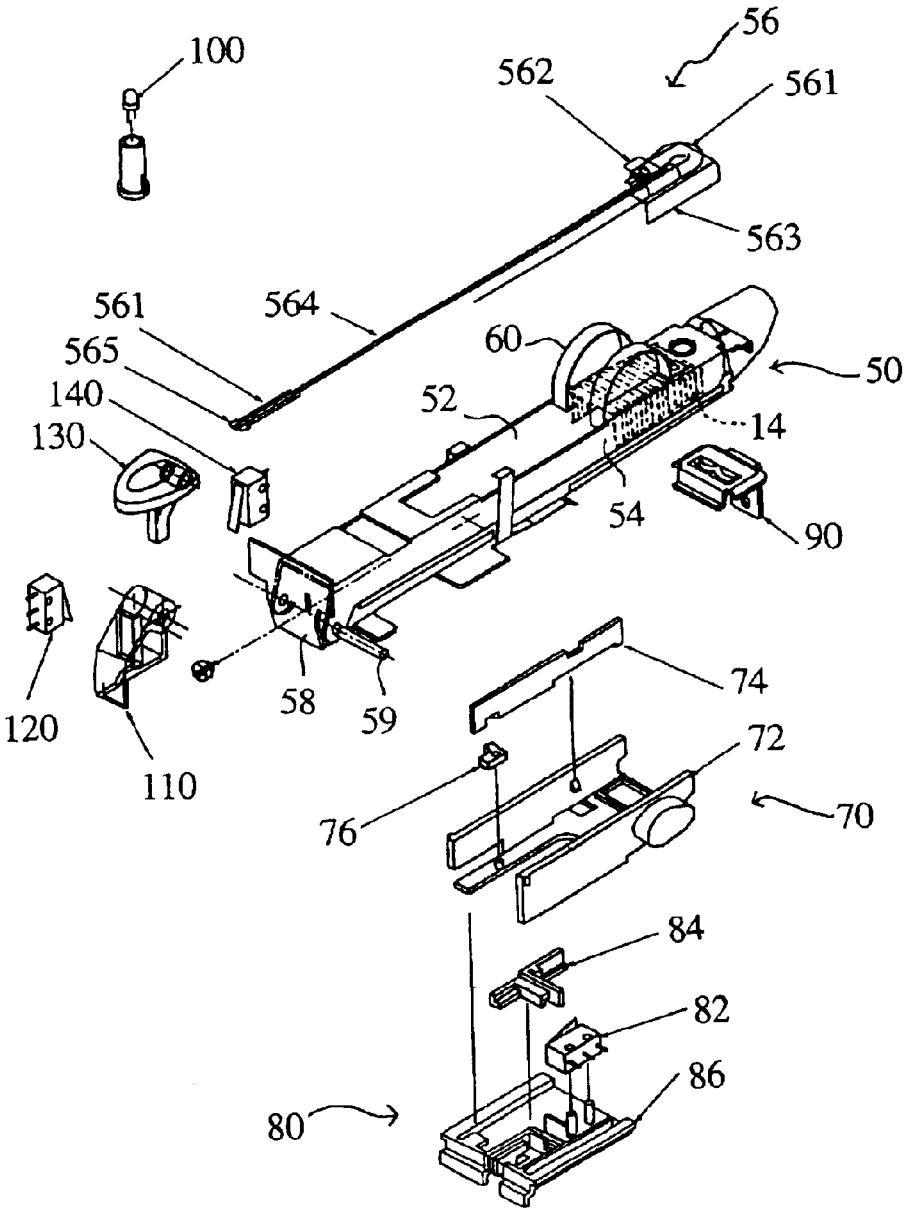
FIG. 2 is a perspective exploded view of the magazine frame area of the electric stapler according to the present invention.
Figure 3:
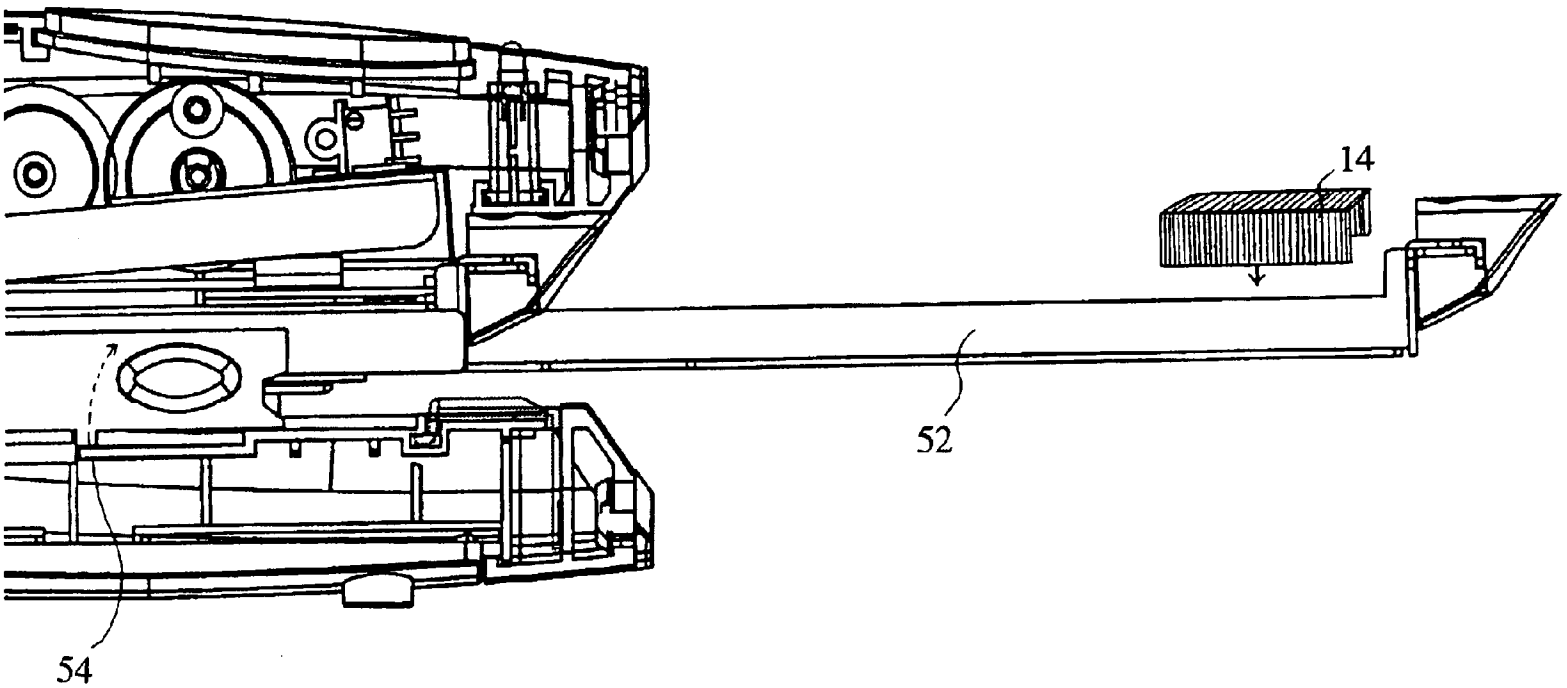
FIG. 3 is a cutaway side view of the magazine frame.
Figure 4:
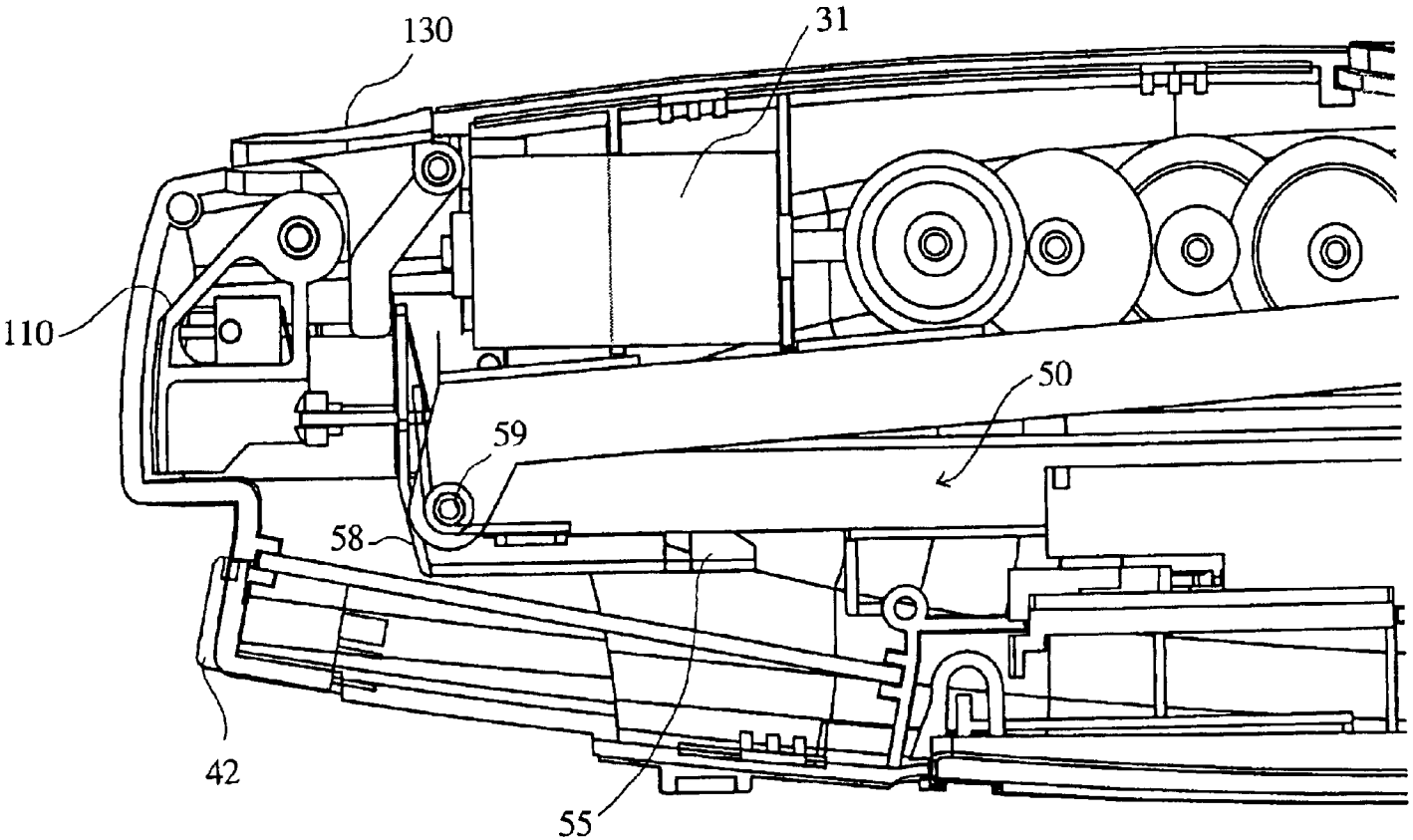
FIG. 4 is a side view of the back end of the electric stapler.
Figure 5:
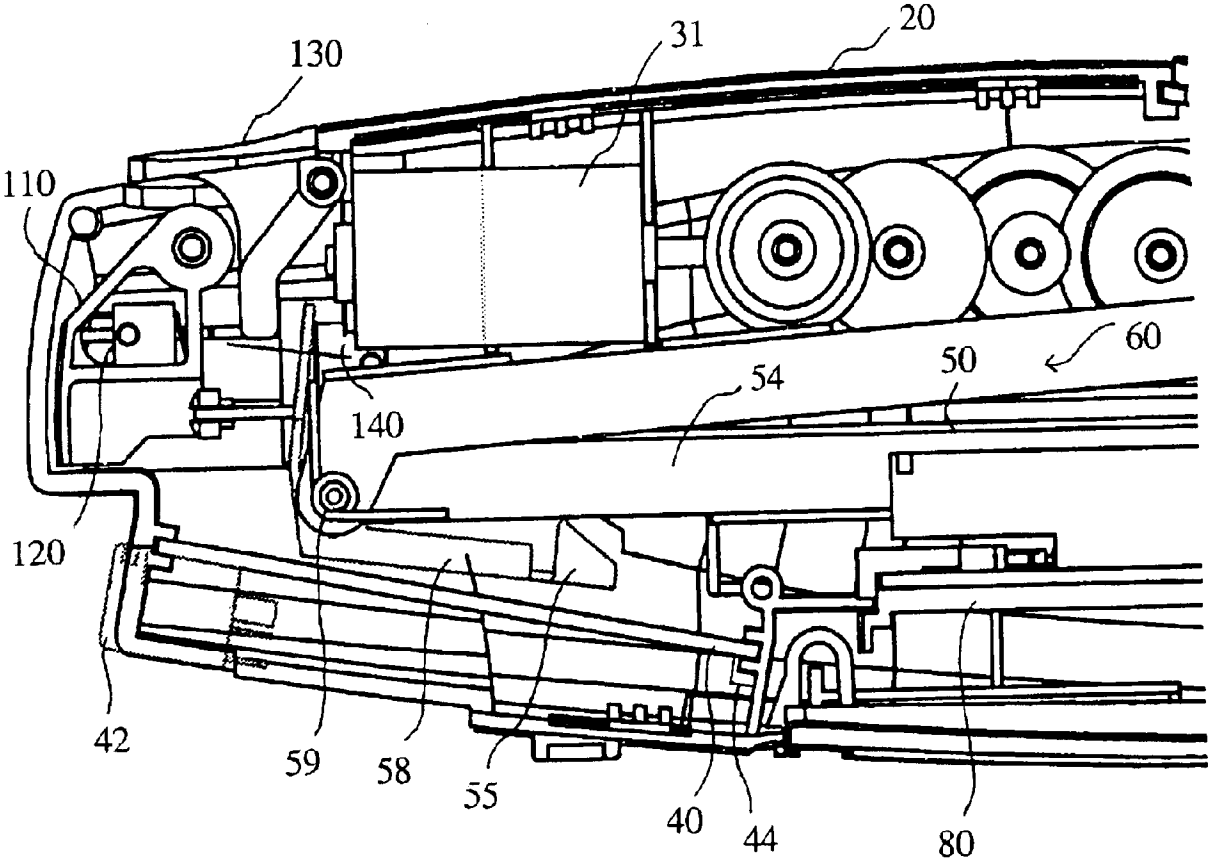
FIG. 5 is a side view of the back end when the refill button is pushed.

An electric stapler that is an embodiment of the present invention will now be explained in detail with reference to the drawings. FIG. 1 is a side view of the electric stapler according to the present invention. FIG. 2 is a perspective exploded view of the magazine frame and actuating bar of the electric stapler according to the present invention. FIG. 3 is a cutaway side view of the magazine frame. FIG. 4 is a side view of the back end of the electric stapler. FIG. 5 is a side view of the back end when the refill button is pushed.

As shown in FIG. 1, the electric stapler 10 according to the present invention consists of a case body 20, drive train 30, wiring board 40, frame 50, arm 60, actuating bar 70, fixed switch 80 and an LED display 100.

The case body 20 is a box that encloses the drive train 30, wiring board 40, frame 50, arm 60, actuating bar 70, fixed switch 80 and the like, and is also provided with a battery storage area 22.

The drive train 30 consists of a motor 31 that rotates when supplied with power and acts as the source of driving power from the wiring board 40, a gear 32 engaged to the rotating shaft of the motor, and a train of gears 33, 34, 35, 36 which are sequentially engaged to gear 32. The motor 31 may operate on either AC power or DC power.

When the motor begins to operate, the engaged gears are driven sequentially and the rotary motion is transmitted so that gear 36 rotates. On both side surfaces of gear 36 are raised protrusions 36*a* and 36*a*'. The protrusions 36*a* and 36*a*' are engaged within a semicircular engagement circle 62 provided on the arm 60. When the gear 36 rotates clockwise, the protrusions 36*a* and 36*a*' come into contact with the upper surface of the arm 60, push the front end of the arm down and perform the operation of pushing down the arm which is the stapling action. When the gear 36 is rotated further from the pushed-down state, the protrusions 36*a* and 36*a*' rotate and come into contact with the inside wall of the engagement circle 62, thereby performing the operation of raising the arm 60 up to its original state.

The wiring board 40 is a flat board on which are provided ICs, capacitors and the like used to control the electric stapler 10. In addition, the wiring board 40 is also provided with an AC power connector 42 that connects to an AC power supply, and a battery power connector 44 that connects to a battery.

The magazine frame 50 is a box that stores staples 14 used when stapling a document sheaf 12 or the like, consisting of an inner frame 52, outer frame 54 and a staple guide 56.

The inner frame 52 is the magazine that stores staples, and when a refill button 130 provided at the back end of the electric stapler 10 is pressed, an engager 58 rotates about a shaft 59 so that the releaser provided on the front tip of the engager 58 moves and releases the engagement of the magazine frame. This causes the magazine frame to spring out forward in the longitudinal direction so that the work of removing or replenishing the staples 14 can be performed.

The outer frame 54 is a box-shaped frame used to enclose the inner frame 52.

The staple guide 56 guides the staples 14 stored in the inner frame 52 under pressure toward the front end of the stapler, and consists of a spring 561 which provides the pressing force, a slide plate 562 which is a moving body, a downward-facing generally U-shaped stapler guide 563 which pushes the staples forward, a shaft 564 and a cap 565 which contacts the switch at the back end of the shaft.

The spring 561 is made of compressible spring material, and as shown in FIG. 2, has one end fixed to the rear end in the longitudinal direction and the other end extended to a support column provided at the front end of the frame, and then rotated halfway around the support column and doubled back and mounted on the slide plate 562. Thereby, the slide plate 562 is pushed in the direction of the front end of the electric stapler 10, and the staples contained therein are moved under pressure toward the front end.

A shaft 564 is provided in the center and the spring 561 is mounted along the shaft such that it is able to be compressed and expanded freely, and thus the staples loaded ahead of the slide plate 562 which is mounted doubled over are pushed in the direction of the front end of the stapler.

The arm 60 consists of a semicircular engagement circle 62 that engages the protrusions 36*a* of gear 36, and a plate-shaped driver 64 used for pushing down staples installed at the front end. One of the staples lined up at the very front end of the staples stored in the magazine frame 50 is separated from the line of staples and pressure is applied to push it downward so that it penetrates the edge of a document or the like, thereby completing the operation of stapling the document. The engagement circle 62 is formed in a roughly semicircular shape, being coupled to the circular motion of the protrusions 36*a* and 36*a*' of the gear 36, thereby causing the arm 60 to move up and down.

The operation and equipment for converting the rotation of the gear 36 into up and down motion of the arm are identical to those used conventionally, as the protrusions 36*a* and 36*a*' raised on both sides of the gear rotate together with the gear, come in contact with the upper surface of the arm and push the entire arm down. As the rotation proceeds further, the driver 64 mounted on the tip of the arm separates the foremost staple from the rest of the staples, drives it through the document sheaf 12 or the like to be stapled until it penetrates the back surface of the document and the protruding legs of the staple are bent inward and clinched to complete the stapling.

Even after the operation of stapling documents is complete, the protrusions 36*a* and 36*a*' continue to rotate further, moving within the circle of the engagement circle and coming into contact with the inside wall of the engagement circle 62. Thereby, with further rotation, the protrusions raise the arm 60 mounted on the engagement circle back to the position it was in prior to being lowered.

The actuating bar 70 has a structure such that it can move forward and backward in the longitudinal direction, serving to determine the position at which the document sheaf or the like is stapled and also starting the motion of the electric stapler 10 by being coupled to the fixed switch 80. The actuating bar 70 has a structure consisting of a paper guide 72 serving as a stopper for the document sheaf or the like to be stapled, a slider 74 that is pushed by the inserted document sheaf or the like and pushes and moves a crank 76, and the crank 76 which is engaged to this slider and pushes and moves a slide member 84 of the fixed switch 80.

The fixed switch 80 that serves as the starting switch for the electric stapler consists of a differential switch 82, slide member 84 and switch base 86.

The differential switch 82 is fixed to the switch base 86 and wired to the wiring board 40. When the differential switch 82 is pressed in the insertion direction by the front end of the document sheaf or the like to be stapled, current flows through the wiring board 40 and the drive train 30 begins to operate so that it is possible to staple the documents or the like.

The slide member 84 is engaged with the crank 76 of the actuating bar 70. It is constituted such that when the crank 76 is rotated by the slide of the slider 74, the slide member 84 is pushed and the differential switch 82 is opened or closed.

The operation of an electric stapler according to the present invention will now be explained in detail with reference to the drawings. First, the protrusion provided on the side of the actuating bar 70 is moved forward or backward by hand to determine the position at which the document sheaf is to be stapled. Once the position of the actuating bar 70 is determined, the document sheaf to be stapled is placed in the slit of the electric stapler and inserted from the left in the figure. The front end of the inserted document sheaf presses upon and moves the paper guide 72 and slider 74 of the actuating bar 70. Moreover, the engaged crank 76 is coupled and moved forward or backward. The crank 76 pushes the slide member 84 of the fixed switch 80 and furthermore presses the differential switch 82. The depressed differential switch 82 causes electric power to be supplied to the wiring board 40 and the drive train 30 operates.

The rotary drive apparatus (motor) 31 of the drive train 30 operates to rotate the driveshaft and the train of engaged gears 33, 34, 35, 36 are sequentially operated. Protrusions 36*a* are raised on gear 36, and the circular motion of the protrusions 36*a* compresses the arm 60. A semicircular engagement circle 62 is mounted on the upper surface of the drive train 30 to engage the protrusions 36*a*. The protrusions 36*a* and 36*a*' are raised on the side surfaces of the gear 36 and the rotary motion of the gear causes motion in a circular track. When the protrusions 36*a* move toward the bottom of the gear 36 they come into contact with the upper surface of the arm 60 and push the arm down. As the arm 60 drops, exactly one of the staples 14 stored in the magazine frame 50 is pushed down by the driver 64 of the arm 60 and enters and penetrates the edge of the document sheaf, protruding from the bottom surface of the document sheaf and being guided and bent in the opposite direction by an anvil 90. After further driving and pushing, it returns to come into contact with the rear surface of the document sheaf and crimps to staple the document sheaf.

As shown in FIG. 2, the lighting of the LED and operation of the frame are such that when more than a fixed quantity of staples is loaded into the electric stapler, the LED turns off. Specifically, the slide plate 562 of the magazine frame 50 is moved back to a position determined by the quantity of staples loaded, so the spring 561 is stretched. The shaft 564 connected to the slide plate 562 is positioned in back so the cap 565 provided at the back end of the shaft 564 is also positioned in back, and the switch crank 110 joined to this cap is pushed, thus turning off the LED switch 120. The circuitry mounted on the wiring board 40 causes the LED display 100 to be turned off when the LED switch 120 is pushed.

In addition, when the quantity of staples 14 remaining reaches roughly 20, the slide plate 562 again moves forward at this position. In this state, the front end of the shaft 564 is also positioned forward, and the cap 565 at the back end of the shaft 564 separates from the switch crank 110 and the depressed switch crank 110 also separates from the LED switch 120. This means that the LED switch is no longer pressed and the circuitry of the wiring board 40 causes current to flow through the LED display 100 so that it lights.

To load staples, the refill button 130 is pressed with a finger or the like, causing the refill button 130 to push the engager 58 and release the lock so that the inner frame 52 of the magazine frame 50 springs forward in the longitudinal direction. In addition, at this time the engager 58 presses the LED turn-off switch 140, thereby preventing the LED 100 from turning on.

The electric stapler 10 according to the present invention has batteries loaded in the battery storage area 22 of the case body 20 and connected to the battery power connector of the wiring board 40, thus making it rechargeable. The stapler may be recharged by connecting an AC power supply to the AC power connector 42 of the wiring board 40, or the stapler may be operated with the AC power supply connected.

FIG. 3 is a side view showing the inner frame 52 removed from the interior of the case body 20 at the time of loading staples. As shown in the figure, the inner frame 52 has sprung forward from the case body 20 in order to load staples. The staples 14 are inserted such that they straddle the internal frame with their legs pointing down. This makes it possible to load the staples easily.

FIGS. 4 and 5 are side views of the electric stapler according to the present invention, where FIG. 4 is a side view of the operating state and FIG. 5 is a side view of the state when the refill button 130 is pushed. In the normal operating state shown in FIG. 4, the releaser 55 of the engager 58 is engaged to the bottom surface of the outer frame 54 and the magazine frame 50 is locked so that it does not move. In the state shown in FIG. 5 with the refill button 130 pressed, the refill button 130 pushes the engager 58 and thus the engager 58 rotates about the shaft 59, so the releaser 55 at the front end is separated from below from the bottom surface of the magazine frame 50 and unlocked, so the inner frame 52 springs out forward longitudinally from the magazine frame 50.

In addition, in order to prevent the LED from turning on at the time that the refill button 130 is pushed to load staples, when the refill button 130 is pushed the engager 58 pushes the LED turn-off switch 140 mounted on the back end of the motor 31. With this LED turn-off switch, the LED 100 will not light even if the internal frame has sprung out and the stapler is open.

As explained in the foregoing, the electric stapler according to the present invention is electric so it can automatically staple sheaves of documents or the like. Specific advantages offered include:

1. The actuating switch is a fixed switch that is fixed to the case body so it has a durable construction.

2. The actuating bar can be moved forward or backward in the longitudinal direction, so the stapling position can be easily determined.

3. An LED that indicates the quantity of staples remaining is included, so it is possible to determine at a glance whether staples are present without opening the stapler.

4. A battery connector is installed on the wiring board and a battery storage area is provided, so battery-powered operation is possible.

5. An AC power connector is installed on the wiring board, so the batteries can be recharged, and also, the electric stapler can be operated and driven by AC power.

What is claimed is:

1. An electric stapler comprising:

a case body;

a drive train comprising a rotary drive apparatus and gears;

a wiring board provided with electrical circuitry;

a magazine frame that stores staples;

an arm that pushes staples stored in said magazine frame from above to penetrate and staple sheets;

a fixed switch mounted on said case body and provided with an actuating switch for actuating the rotary drive apparatus; and an actuating bar provided on said fixed switch that actuates the fixed switch and is configured to move to a plurality of stapling positions.

2. The electric stapler according to claim 1, further comprising a battery installed as an independent source of driving power, and an AC power connector and AC-DC converter for an AC power supply provided separately on said wiring board.

3. The electric stapler according to claim 1, wherein said fixed switch comprises the actuating switch for actuating the rotary drive apparatus of the drive train, a slide member coupled to a crank of the actuating bar, and a switch base on which said actuating switch and said slide member are mounted on the case body.

4. The electric stapler according to claim 1, wherein said actuating bar comprises a paper guide structured and arranged as a stopper for the sheets to be stapled, a slider member that is pushed by the sheets and that actuates a crank, and the crank coupled to a slide mechanism of said fixed switch.

5. The electric stapler according to claim 1, further comprising an LED display that lights when the staples run low, whereby a low supply of staples within the magazine frame can be determined.

6. The electric stapler according to claim 1, wherein the drive train rotary drive apparatus comprises a motor.

7. An electric stapler comprising:

a case body;

a drive train comprising a rotary drive apparatus and gears;

a wiring board provided with electrical circuitry;

a magazine frame that stores staples;

an arm that pushes staples stored in said magazine frame from above to penetrate and staple sheets;

a fixed switch mounted on said case body and provided with an actuating switch for actuating the rotary drive apparatus; and an actuating bar provided on said fixed switch at an arbitrary position, wherein said fixed switch comprises the actuating switch for actuating the rotary drive apparatus of the drive train, a slide member coupled to a crank of the actuating bar, and a switch base on which said actuating switch and said slide member are provided and which is mounted on the case body.

8. The electric stapler according to claim 7, wherein the drive train rotary drive apparatus comprises a motor.

9. The electric stapler according to claim 7, further comprising a battery installed as an independent source of driving power, and an AC power connector and AC-DC converter for an AC power supply provided separately on said wiring board.

10. An electric stapler comprising:

a case body;

a drive train comprising a rotary drive apparatus and gears;

a wiring board provided with electrical circuitry;

a magazine frame that stores staples;

an arm that pushes staples stored in said magazine frame from above to penetrate and staple sheets;

a fixed switch mounted on said case body and equipped with an actuating switch for actuating the rotary drive apparatus; and an actuating bar provided on said fixed switch at an arbitrary position, wherein said actuating bar comprises a paper guide structured as a stopper for the sheets to be stapled, a slider member that is pushed by the sheets and that actuates a crank, and the crank coupled to a slide mechanism of said fixed switch.

11. The electric stapler according to claim 10, wherein the drive train rotary drive apparatus comprises a motor.

12. The electric stapler according to claim 10, further comprising a battery installed as an independent source of driving power, and an AC power connector and AC-DC converter for an AC power supply provided separately on said wiring board.

13. An electric stapler comprising:

a case body;

a drive train comprising a rotary drive apparatus and gears;

a wiring board provided with electrical circuitry;

a magazine frame that stores staples;

an arm that rushes staples stored in said magazine frame from above to penetrate and staple sheets;

a fixed switch mounted on said case body and equipped with an actuating switch for actuating the rotary drive apparatus;

an actuating bar provided on said fixed switch at an arbitrary position; and an LED display that lights when a supply of the staples runs low, whereby a low supply of staples within the magazine frame can be determined.

14. The electric stapler according to claim 13, wherein the drive train rotary drive apparatus comprises a motor.

15. The electric stapler according to claim 13, further comprising a battery installed as an independent source of driving power, and an AC power connector and AC-DC converter for an AC power supply provided separately on said wiring board.

* * * * *

UNITED STATES PATENT AND TRADEMARK OFFICE

CERTIFICATE OF CORRECTION

PATENT NO. : 6,811,070 B2
DATED : November 2, 2004
INVENTOR(S) : T. Takada

It is certified that error appears in the above-identified patent and that said Letters Patent is hereby corrected as shown below:

Title page,
Item [30], Foreign Appliaction Priorty Data, should be included:
-- May 13, 2002 Japan 2002-136767 --

Column 8,
Line 32, “rushes” should be -- pushes --.

Signed and Sealed this

Fourteenth Day of June, 2005

JON W. DUDAS
*Director of the United States Patent and Trademark Office*